US006854878B2

(12) United States Patent
Jacob

(10) Patent No.: US 6,854,878 B2
(45) Date of Patent: Feb. 15, 2005

(54) MIXING APPARATUS

(75) Inventor: Hans-Joachim Jacob, Ballrechten-Dottingen (DE)

(73) Assignee: YSTRAL GmbH, Ballrechten-Dottingen (DE)

( * ) Notice: Subject to any disclaimer, the term of this patent is extended or adjusted under 35 U.S.C. 154(b) by 147 days.

(21) Appl. No.: 10/275,128

(22) PCT Filed: May 11, 2001

(86) PCT No.: PCT/DE00/01812

§ 371 (c)(1),
(2), (4) Date: Oct. 31, 2002

(87) PCT Pub. No.: WO01/87474

PCT Pub. Date: Nov. 22, 2001

(65) Prior Publication Data

US 2003/0107948 A1 Jun. 12, 2003

(30) Foreign Application Priority Data

May 16, 2000 (DE) ..... 100 23 694

(51) Int. Cl.[7] ..... B01F 7/10
(52) U.S. Cl. ..... 366/304
(58) Field of Search ..... 366/178.1–178.3, 366/96–99, 262, 306, 181.4, 304, 305, 317

(56) References Cited

U.S. PATENT DOCUMENTS 2,176,899 A * 10/1939 Gordon et al. ..... 366/304
3,194,540 A * 7/1965 Hager ..... 366/305
3,195,867 A * 7/1965 Mould, Jr. ..... 366/305
4,431,482 A * 2/1984 Heinbockel et al. ..... 366/304
5,540,499 A 7/1996 Seeger
6,000,840 A 12/1999 Paterson
6,648,500 B2 * 11/2003 Fedorov et al.
2001/0036125 A1 * 11/2001 Bachelier et al. ..... 366/304

FOREIGN PATENT DOCUMENTS

| | | | |
|---|---|---|---|
| DE | 1 040 513 | | 10/1953 |
| GB | 2165462 A | * | 4/1986 |
| WO | 80/01469 | * | 7/1980 |

* cited by examiner

*Primary Examiner*—Charles E. Cooley
(74) *Attorney, Agent, or Firm*—Baker & Daniels

(57) ABSTRACT

A mixing apparatus having a mixer unit (7) which includes a cup-shaped stator (24, 33) and a rotor (17) located in the mixing chamber (18). Two inputs (6, 8) and an output (13) are provided. The mixing chamber (18) is divided into a plurality of mixing regions by a separating disc (20). Inner blades (21) and outer blades (22) are provided. An edge rail (37) is positioned in the plane of the separating disk (20), between the inner (21) and outer (22) blades. The stator (24, 33) has a different configuration in the various mixing areas of the mixing chamber (18). As a result, different yield and mixing ratios can be obtained in the mixing areas of the mixing chamber (18).

9 Claims, 6 Drawing Sheets

MIXING APPARATUS

BACKGROUND OF THE INVENTION

This invention relates to devices for mixing substances, especially for dispersing, suspending, and emulsifying gases and/or liquids and/or free-flowing solid substances, with a rotor that has a partition plate, inner blades, and outer blades, and with a cup-shaped stator whose wall is penetrated by holes. The stator is positioned between the inner blades and the outer blades of the rotor, with the rotor and the stator being located in a mixing chamber. A first product inlet opens into the mixing chamber at one side of a partition plate, and with a second product inlet and a product outlet associated with the partition plate opening at the other side of the partition plate in question.

A prior art device is disclosed in U.S. Pat. No. 5,540,499. This prior art device has a stator that is located in a mixing chamber into which the substances to be mixed can be introduced through product inlet connectors. Rounded holes of identical dimensions are introduced into the wall of the stator up to an edge rail that closes off the stator. There is also a rotating rotor made with a partition plate and inner blades and outer blades, with the partition plate being located inside the rotor. Substances fed into the mixing chamber are mixed intensively with one another by the interaction of stator and rotor. Although such a device is also commonly called an in-line disperser, and will provide relatively good mixing results, it is desired to mix with higher throughput and the most flexible possible matching to the particular necessary mixture ratios.

DE-B-10 40 513 discloses a device for mixing substances that is designed as an immersion apparatus or a so-called batch disperser and that has a cylindrical stator with two rows of slotted stator holes in the wall of the stator in the circumferential direction oriented at an angle in the radial direction. An intermediate rail is provided between the rows of stator holes. The dimensions of the stator holes of one row are different from the dimensions of the stator holes of the other row.

The last-mentioned prior art device also has a cylindrical rotor that is mounted to rotate inside the stator, with the inner wall of the stator and the outer wall of the rotor being spaced at a very small distance from one another. The wall of the rotor is likewise provided with two rows of slotted rotor holes oriented radially, but with the dimensions of the rotor holes being the same in each row. There is a partition plate between the rows of rotor holes that is made to connect two mixing regions on the two sides of the partition plate with a number of axially oriented connecting holes. This prior art device, however, has the drawback that, because of the double task produced by the configuration of the immersion apparatus, namely having to circulate the contents of the tank in which it is immersed in addition to mixing the substances themselves, the mixing is unsatisfactory despite the connecting holes provided for better circulation, especially with relatively large tanks, so that the type of apparatus has not become popular for mixing large quantities of substances.

U.S. Pat. No. 6,000,840 also discloses a device designed as an immersion apparatus for mixing substances with a cylindrical stator that has two rows of elongated holes made in the wall. The holes in the rows are spaced radially from one another and are oriented to run in succession at an angle to a central plane of the stator. The rotor, mounted to rotate inside the stator, has V-shaped inner blades extending over the entire inside diameter and height of the stator, with the arms of the inner blades each being oriented perpendicular to the longitudinal direction of the holes. This does produce relatively good dispersing action, but the aforementioned drawbacks typical of immersion apparatus also exist.

SUMMARY OF THE INVENTION

The objective of the invention is to provide a mixing device in which very diverse throughputs and mixture ratios can be set, with relatively high throughput and with relatively little changeover work.

This objective is achieved with a mixing device according to a first embodiment of the invention, by providing that the edge rail is in the plane of a partition plate and that the (or each) partition plate divides the mixing chamber into separate mixing regions, with substance exchange between the mixing regions in the mixing chamber being prevented.

This objective is also achieved with a mixing device according to a second embodiment of the invention, by providing at least two rows of holes into the wall of the stator in the circumferential direction, with the dimensions of the holes of one row being different from the dimensions of the holes of the other row. A circumferentially continuous intermediate rail is provided between each two adjacent rows of holes. The intermediate rail is positioned in the plane of an associated partition plate of the rotor. The (or each) partition plate divides the mixing chamber into separate mixing regions, with substance exchange between the mixing regions in the mixing chamber being prevented.

The single general inventive concept underlying both embodiments of the invention is to configure the wall of the stator into different mixing regions of the mixing chamber by means of partition plates. This provides the ability to set throughput and mixture ratios in a first infeed of a substance into one mixing region that are different from the corresponding conditions of a mixing region positioned at the other side of the particular partition plate. In this case, the device according to the first embodiment of the invention can be considered as the limiting case of the device according to the second embodiment which has a single hole extending over the entire perimeter of the wall.

By providing at least one intermediate rail in the second embodiment of the invention, relatively large stators in the longitudinal direction can also be used without the risk of breaking strips of material between holes because of the mechanically stabilizing action of the intermediate rails.

By providing multiple partition plates and a corresponding number of substance inlets and substance outlets, multistage mixing processes can also be projected with devices according to the invention.

In a device according to the first embodiment of the invention, it is advantageous for separating the mixing regions to provide that the edge rail is thinner than the partition plate.

If no mixing action is to occur in the second mixing region, or very little mixing action, in a refinement of the device according to the first embodiment of the invention, it is suitable to provide a single row of holes, with the holes of this one row being oriented diagonally to the longitudinal direction of the stator.

In another refinement of the device according to the first embodiment of the invention, at least two rows of holes are provided. This refinement is intended for multistage mixing processes.

In a device according to the second embodiment of the invention, and in a device according to the first embodiment of the invention designed for multistage mixing processes, it is desirable for the widths of the holes in different rows to be different. In a further refinement in this regard, it is desirable for the number of holes in at least two rows to be different to set particularly different mixing proportions in different mixing regions.

In a device according to the second embodiment of the invention, and in a device according to the first embodiment of the invention designed for multistage mixing processes, it is desirable, for increased or reduced substance input, to provide that the holes of at least one row are oriented at an angle (diagonally) to the longitudinal direction of the stator. In a further refinement in this regard, it is desirable for the holes of at least two rows to be oriented at an angle to one another. In this way, different inputs of substances can be produced into the particular mixing regions.

In a device according to the second embodiment of the invention, and in a device according to the first embodiment of the invention designed for multistage mixing processes, for essentially complete separation of the mixing regions on both sides of a partition plate, it is desirable for each of the intermediate rails to be thinner than their associated partition plates.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENT

Figure 1:
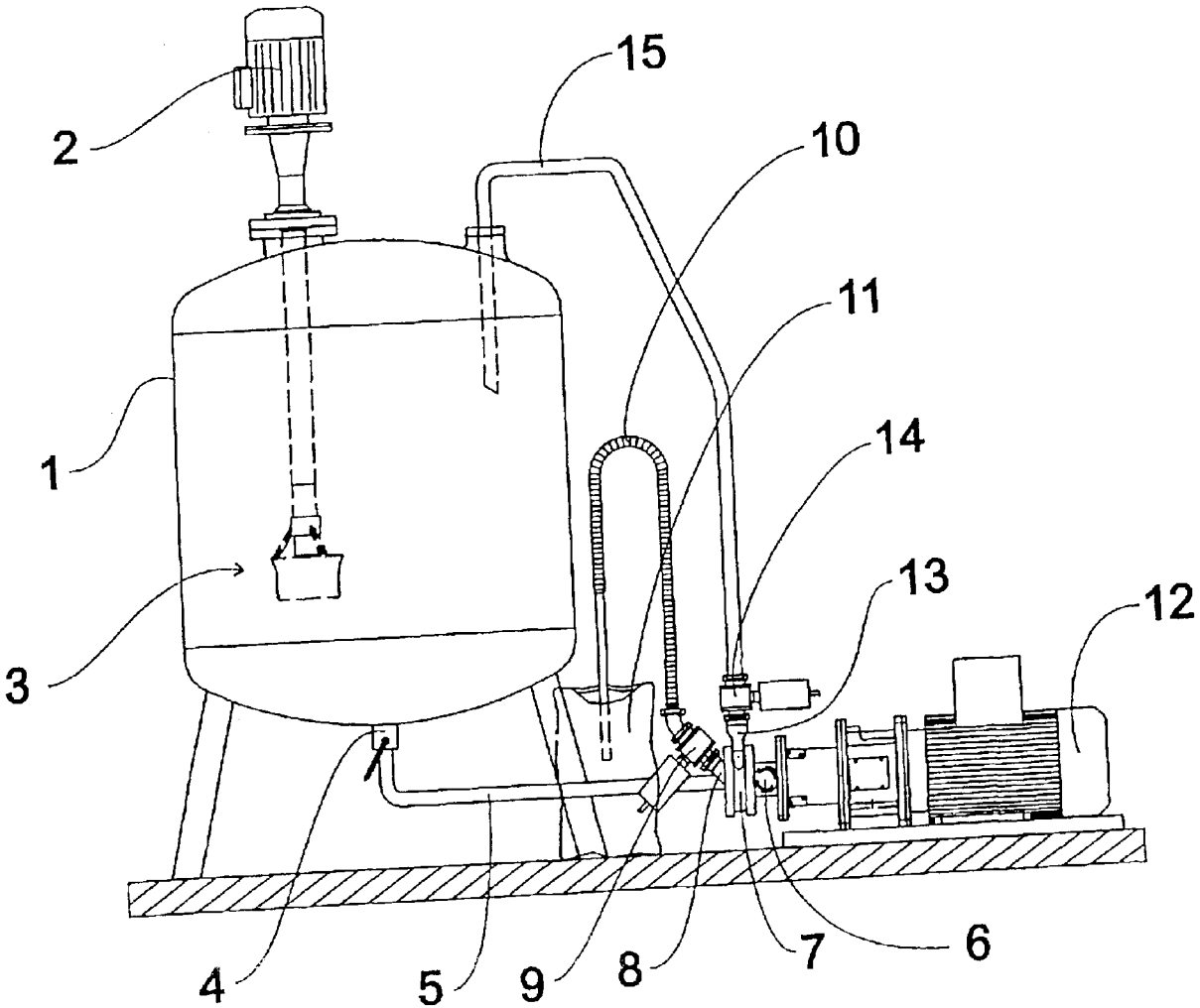
FIG. 1 is a side elevational view of a mixing device according to the invention with two substance inlets and one substance outlet.

FIG. 1 shows, in side view, a tank 1, in which a liquid is stored at the beginning of a mixing process as the first substance of a mixture of substances to be produced. A mixing mechanism 3 driven by a stirrer drive 2 reaches into the tank. The mixing mechanism 3 preferably extends to the lower region of the tank 1 in order to produce effective thorough mixing.

A product infeed valve 4, which is connected also to a first product infeed line 5, is attached at the bottom of the tank 1, which is tapered downwardly. The first product infeed line 5 opens through a first product inlet connector 6 into a mixing unit 7.

Also attached to the mixing unit 7 is a second product inlet connector 8, to which a product inlet valve 9 is connected. The product inlet valve 9 is also connected to a second product infeed line 10, which extends, in the illustration of FIG. 1, into a bag 11 filled with powder as the second substance.

To carry out the mixing process, the mixing unit 7 is connected to a mixer drive 12.

Finally, the mixing unit 7 has a product outlet connector 13 to which a product outlet valve 14 is connected. The product outlet valve 14 is also connected to a product delivery line 15 that extends into the top of tank 1.

When carrying out the mixing process for mixing the liquid stored in tank 1 as the first substance with the powder stored in the bag 11 as the second substance, the liquid and the powder arrive at the mixing unit 7, and are mixed there with one another as explained in farther detail below, and the resultant product is transferred back into the tank 1. There, the product that has just left the mixing unit 7 is mixed with the liquid in tank 1 and with the already mixed product already present in tank 1, and is thereafter again fed to the mixing unit 7, until the mixing process is complete with an end product that is located in tank 1.

Figure 2:
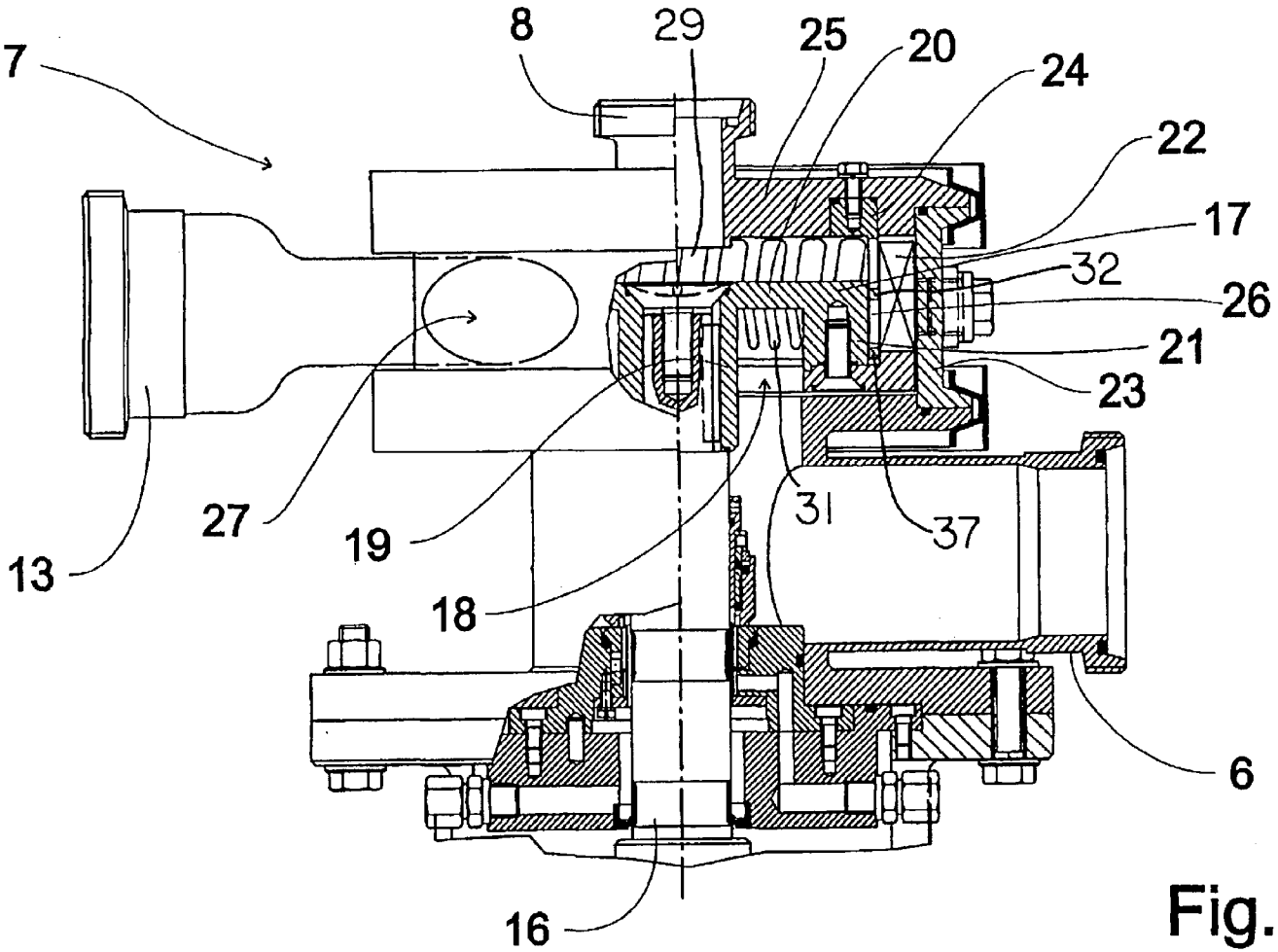
FIG. 2 is an elevational view, partially in cross section, of a first embodiment of a mixing device according to the invention with a stator which has two rows of holes.

FIG. 2 is a partially cutaway view of a first embodiment of the mixing unit 7. The mixing unit 7 has a drive shaft 16 which is connected to the mixing drive 12 of FIG. 1. The drive shaft 16 is securely connected to a rotor 17 which is located in a mixing chamber 18. Rotor 17 has a partition plate 20 extending outwardly radially from a plug bushing 19 connected to the drive shaft 16. Axially oriented inner blades 21 are distributed circumferentially on the outer edge of the partition plate, or disc 20. The inner blades 21 extend only on one side of the partition plate 20 in the embodiment according to FIG. 2. The rotor 17 also has outer blades 22 spaced radially from inner blades 21, and which extend essentially over the entire height of the mixing chamber 18 and are enclosed by an outer wall 23 of mixing chamber 18.

The mixing unit 7 is also equipped with a stator designed as a double-row stator 24 which is attached to a cover flange 25 which closes off mixing chamber 18 in the area of the second product inlet connector 8. The double-row stator 24 is cup-shaped with a circumferential wall 26 which is located between inner blades 21 and outer blades 22 of the rotor 17.

Outer wall 23 of the mixing chamber 18 is apertured in an outlet area 27 in which the product outlet connector 13 is located.

Figure 3:
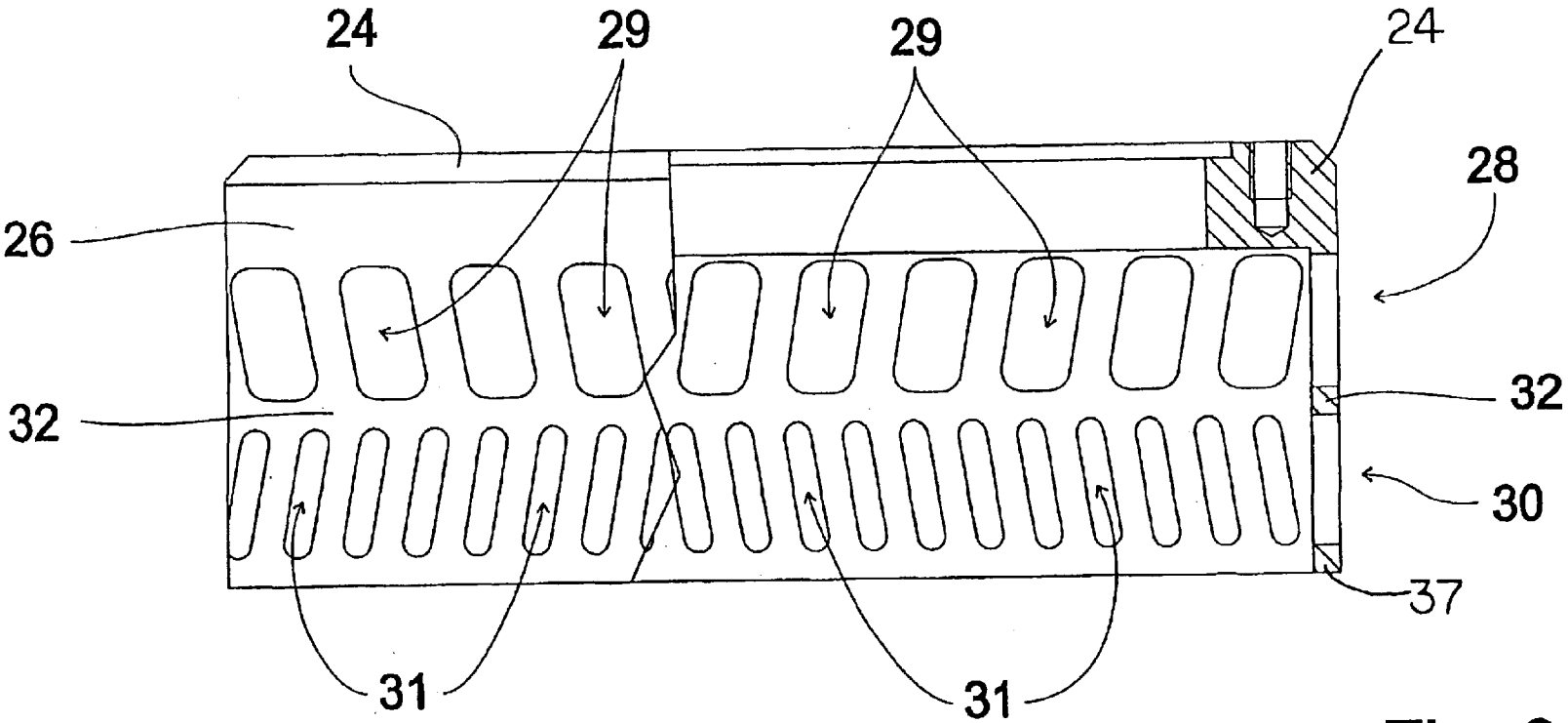
FIG. 3 is a partially cutaway side view of a stator for the mixing device of FIG. 2.

FIG. 3 is a partially cutaway side view of double-row stator 24 of the mixing unit 7 according to FIG. 2. Double-row stator 24 includes a number of first holes 29 provided in wall 26 and which are arranged circumferentially as trapezoids in a fist row 28, uniformly spaced and with rounded corners. Double-row stator 24 also includes a second row 30 of second holes 31 which are likewise provided in wall 26, uniformly spaced and with rounded corners. Second holes 31 of second row 30 are not as wide, circumferentially, as first holes 29 of first row 28. The number of holes 31 in second row 30 is also greater than the number of holes 29 in the first row 28.

In the embodiment of the double-row stator 24 according to FIG. 3, the holes 29, 31 are aligned at an angle to the longitudinal axis of the double-row stator 24. Holes 29, 31 are also arranged at an angle to one another.

A continuous circumferential intermediate rail 32 is provided between holes 29, 31 of two rows 28, 30. The width of intermediate rail 32 in the axial direction of double-row stator 24 is smaller than the width of partition plate 20 in the axial direction of rotor 17. An edge rail 37 borders holes 31 at the ends of holes 31 opposite rail 32.

In operation, the mixing process with a mixing unit 7 according to FIG. 2 and FIG. 3 takes place as follows. Liquid or already partially mixed product flows in the first product inlet connector 6 from the tank 1 into the mixing chamber 18. Powder as the second substance, for example, flows through the second product inlet connector 8 into the mixing chamber 18. The mixing chamber 18 is divided into a first mixing region and a second mixing region by partition plate 20, with one row 28, 30 of holes 29, 31 of different dimensions in each case acting in each mixing region. Since partition plate 20 is wider than intermediate rail 32 and since wall 26 of the stator is immersed between inner blades 21 and outer blades 22 of rotor 17, it is guaranteed that substance exchange between the mixing regions is prevented.

In a mixing unit 7 according to FIG. 2 with a double-row stator 24 according to FIG. 3, thorough mixing that is already relatively good occurs in the first mixing region because of the relatively large dimensions of the first holes 29, combined with a relatively high throughput of the entering second substance. Because of the narrower dimensions of second holes 31 of the second row 30 compared to the dimensions of the first holes 29 of the first row 28, substantially more intensive mixing of the product, which is already partially mixed, occurs in the second mixing region even just after beginning the mixing process, compared to the first mixing region, yet still with a sufficiently high throughput. The arrow-like orientation of holes 29, 31 also increases the transport action in both mixing regions compared to an orientation parallel to the longitudinal direction of the double-row stator 24.

Figure 4:
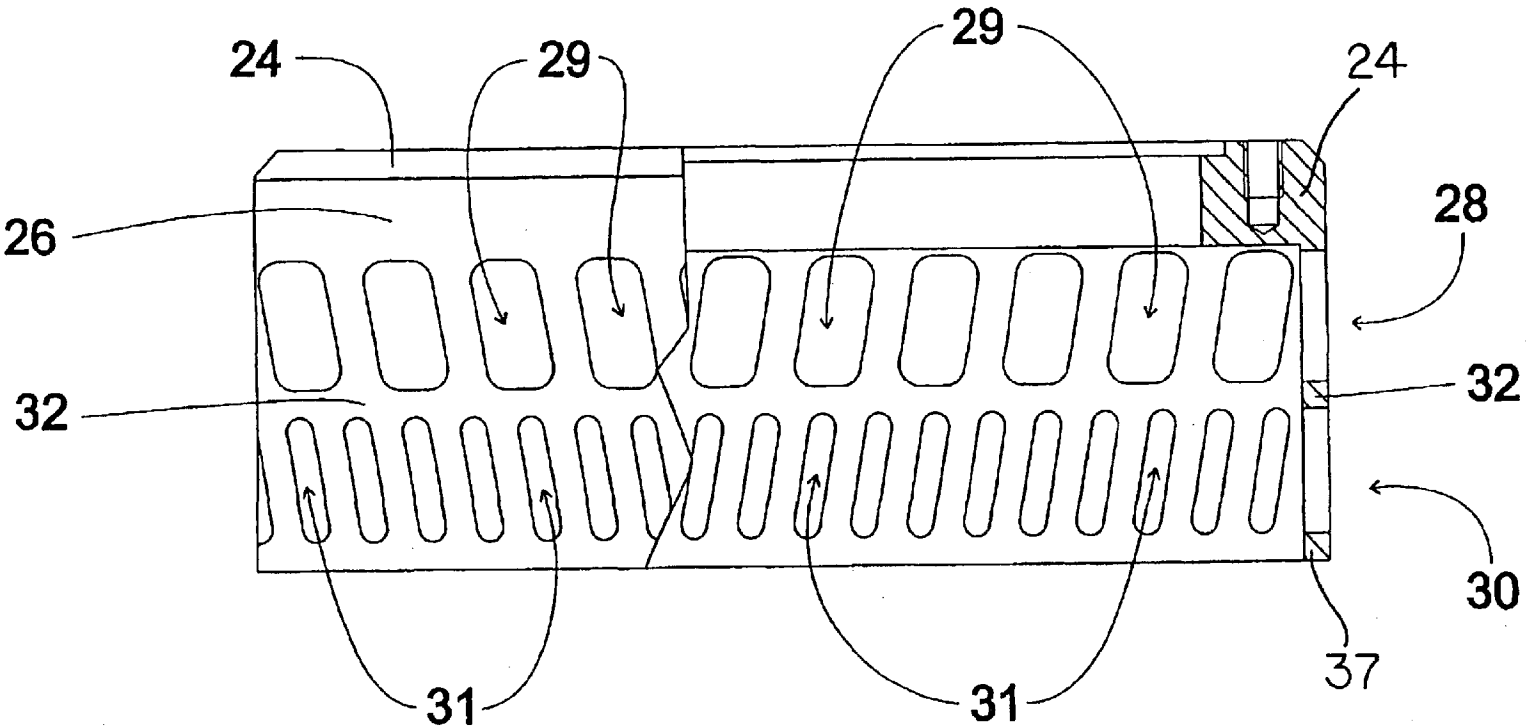
FIG. 4 is a partially cutaway side view of a stator for the mixing device of FIG. 2.

FIG. 4 shows a modification of the double-row stator 24 according to FIG. 3 in which the second holes 31 of the second row 30 are oriented parallel to the first holes 29 of the first row 28, and the holes 29, 31 in each case are at an angle to the longitudinal axis of the double-row stator 24. In this modification, relatively intensive transport, especially of powder as the second substance, into the first mixing region is retained, while because of the orientation of the second holes 31 of the second row 30 modified from the direction of rotation of the rotor 17, compared to the design according to FIG. 3, more intensive mixing is produced in the second mixing region with somewhat reduced throughput.

It is to be understood that other variants with regard to the orientation and dimensions of the holes 29, 31 of the rows 28, 30 can be provided for, depending on the particular throughputs and mixing intensities to be produced in the mixing regions in each case. For example, if the second substance infed through the second product inlet connector 8 has to be relatively intensively mixed even in the first infeed, but then must be subjected only to relatively low mixing forces, the holes in the first mixing region are of relatively small dimensions and in relatively large number, and the holes in the second mixing region are less numerous and of relatively large dimensions.

Figure 5:
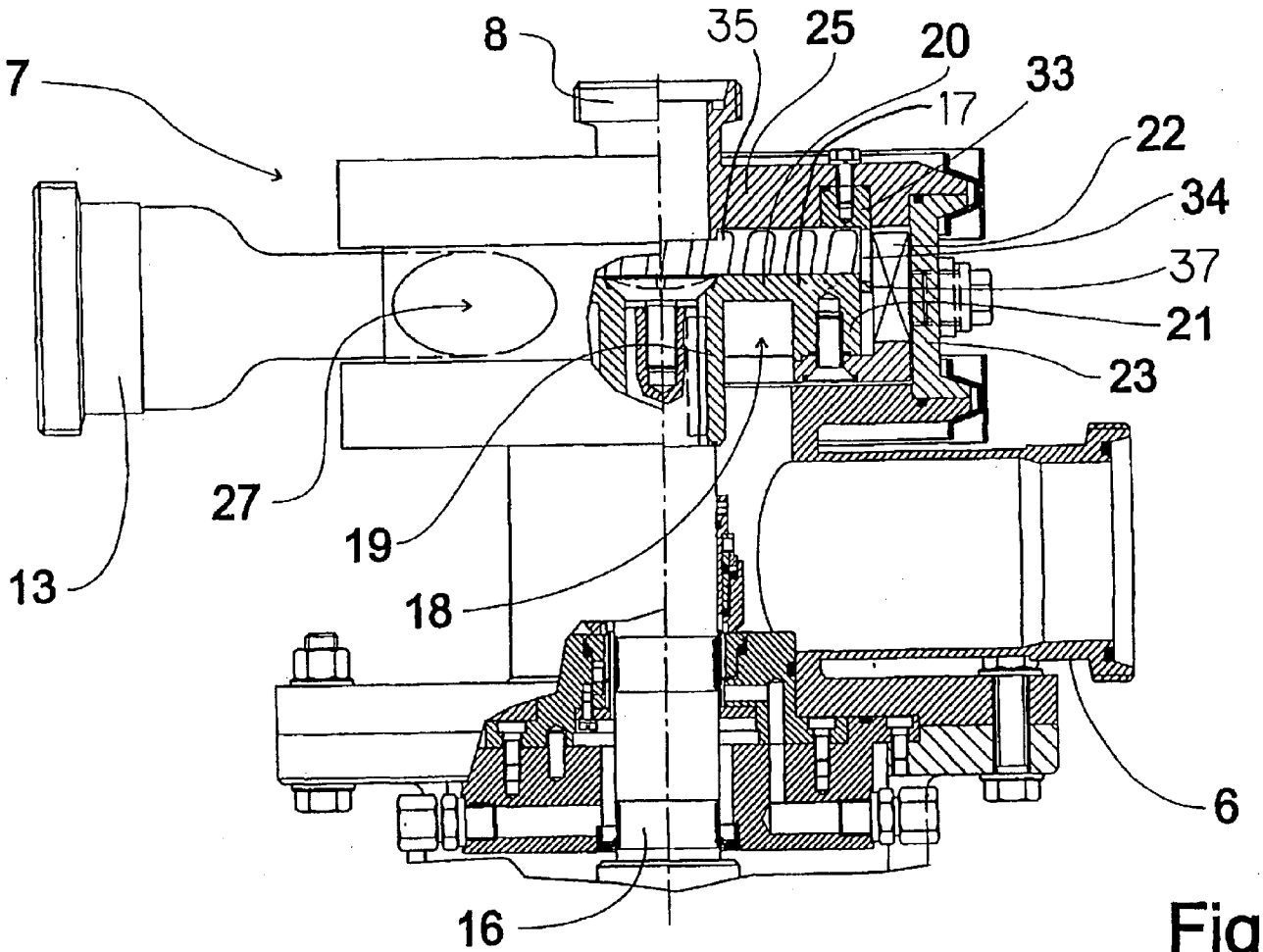
FIG. 5 is an elevational view partially in cross section, of a second embodiment of a mixing device according to the invention with a stator which has only one row of holes that extends over only a portion of the height of the mixing chamber.

FIG. 5 shows a mixing unit 7 that is similar to the mixing unit 7 described with reference to FIG. 2, except for the stator. In this case, identical elements are given the same reference symbols and are not described below in further detail. The mixing unit 7 of FIG. 5 is made with a single-row stator 33 as the stator, whose wall 34 extends only to the area of the partition plate 20 of the rotor 17 and thus only over the first mixing region of the mixing chamber 18, so that the gap between the inner blades 21 and the outer blades 22 of the rotor 17 is open in the second mixing region.

Figure 6:
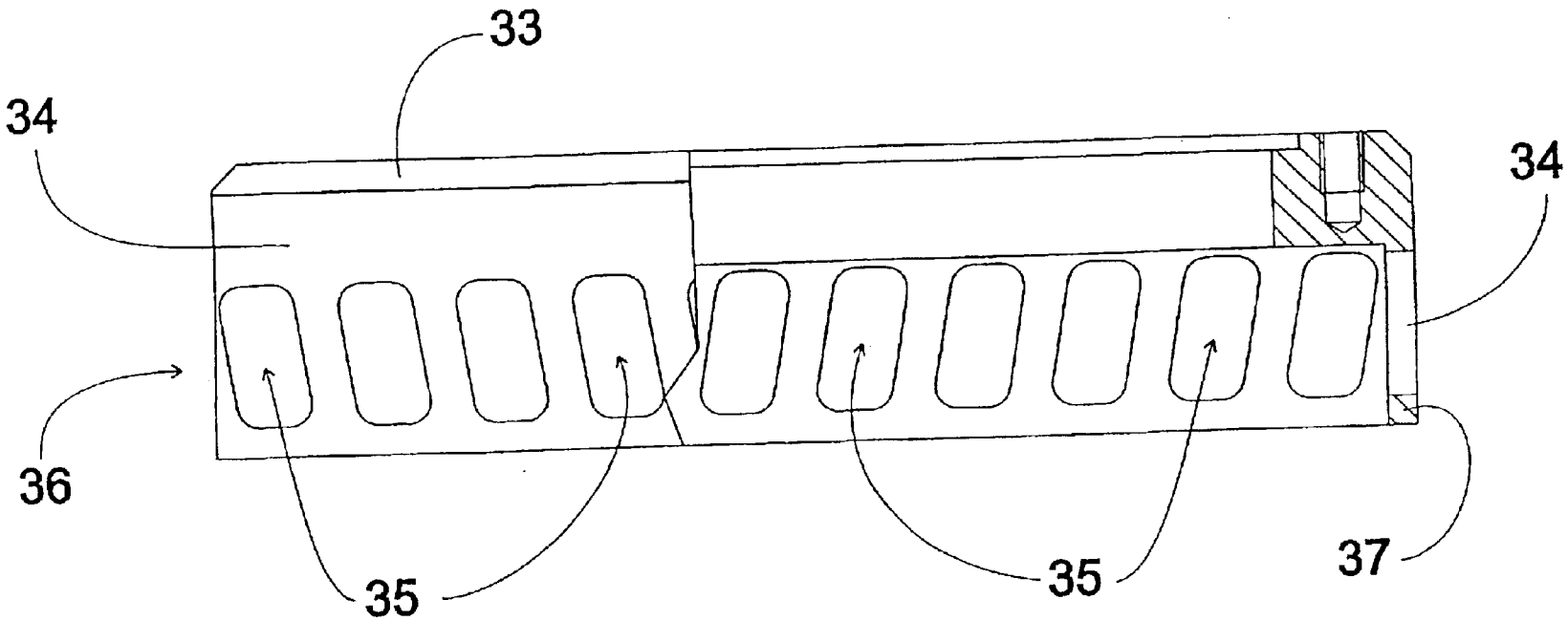
FIG. 6 is a partially cutaway side view of a stator for the mixing unit of FIG. 5.

FIG. 6 shows a side view of the single-row stator 33 according to FIG. 5. Holes 35 are introduced into the wall 34 of the single-row stator 33 that are arranged in only one row 36 and are arranged at an angle to the longitudinal direction corresponding to the holes 29, 31 of the double-row stators 24 of FIG. 3 and FIG. 4. The holes 35 end in a border or edge rail 37 at their end pointing toward the center of the mixing chamber 18 that is thinner than the partition plate 20, corresponding to the intermediate rail 32 of the double-row stators 24.

The mixing process using a single-row stator 33 corresponds basically to the mixing process with a double-row stator 24 described with reference to FIG. 2 and FIG. 3, so that the single-row stator 33 can be considered as the theoretical limiting case of a double-row stator 24 with a single hole in the second row extending over the entire circumference. When using a single-row stator 33, the mixing process in the second mixing region is determined solely by the interaction of the inner blades 21 and the outer blades 22 of the rotor 17, with no mixing, or only extremely little mixing, occurring because of this, for example in the case of products which are very sensitive to shear, such as microballoons, hollow beads, or thickening polymers.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for mixing substances, said apparatus comprising:

a mixing chamber (18), said mixing chamber having a plurality of separate mixing regions;

a rotor (17) disposed in said mixing chamber (18), said rotor including a partition plate (20), inner blades (21) and outer blades (22), said partition plate (20) defining a plane and dividing said mixing chamber into said plurality of separate mixing regions;

an edge rail (37) positioned in the plane of said partition plate (20) between said inner blades (21) and outer blades (22);

a cup-shaped stator (33) disposed in said mixing chamber (18), said stator (33) having a wall (34), said wall (34) including a plurality of holes (35) and terminating at said edge rail (37);

a first product inlet (6) into said mixing chamber (18) located at one side of said partition plate (20);

a second product inlet (8) into said mixing chamber (18); and a product outlet (13) operatively associated with said partition plate (20) and located at the other side of said partition plate (20).

2. The apparatus according to claim 1 wherein said edge rail (37) is thinner than said partition plate (20).

3. The apparatus according to claim 1 wherein said stator includes a single row of holes, said holes oriented at an angle to the longitudinal direction of said stator.

4. An apparatus for mixing substances, said apparatus comprising:

a mixing chamber (18), said mixing chamber having a plurality of separate mixing regions;

a rotor (17) disposed in said mixing chamber (18), said rotor having a partition plate (20), inner blades (21), and outer blades (22), said partition plate defining a plane and dividing said mixing chamber into said plurality of separate mixing regions;

an edge rail (37) positioned between said inner (21) and outer blades (22);

a cup-shaped stator (24) disposed in said mixing chamber (18), said stator having a wall (26) for closing said stator, said wall (26) includes two adjacent rows (28, 30) of holes (29, 31), said two rows of holes extending to said edge rail (37), the dimensions of said holes (29) of one row (28) being different from the dimensions of said holes (31) of said other row (30);

a first product inlet (6) located at one side of said partition plate (20);

a second product inlet (8) into said mixing chamber (18);

a product outlet (13) operatively associated with said partition plate (20) and located at the other side of said partition plate (20); and a circumferentially continuous intermediate rail (32) located between said two adjacent rows (28, 30) of holes (29, 31) in the plane of said partition plate (20).

5. The apparatus according to claim 4 wherein the width of said holes (29) in one row (28) are different from the width of said holes (31) in the other row (30).

6. The apparatus according to claim 4 wherein the number of holes (29) in one row (28) is different from the number of holes (31) in the other row (30).

7. The apparatus according to claim 4 wherein the holes (29) of said one row (28) are oriented at an angle to the longitudinal direction of said stator (24).

8. The apparatus according to claim 7 wherein said holes (29, 31) of said two rows (28, 30) are oriented at an angle to one another.

9. The apparatus according to claim 4 wherein the intermediate rail (32) is thinner than its associated partition plate (20).

* * * * *